United States Patent [19]

Parker

[11] Patent Number: 4,535,496

[45] Date of Patent: Aug. 20, 1985

[54] WATER BED BAR

[76] Inventor: Dennis D. Parker, 6435 SE. Clatsop, Portland, Oreg. 97206

[21] Appl. No.: 549,717

[22] Filed: Nov. 8, 1983

[51] Int. Cl.[3] ..... A47C 27/08

[52] U.S. Cl. ..... 5/451; 5/508; 7/170; 248/351; 81/488; 29/270; 29/278

[58] Field of Search ..... 5/451, 450, 452, 508, 5/482, 488; 248/351; 7/170; 81/3 R; 4/255, 256

[56] References Cited

U.S. PATENT DOCUMENTS

| | | | |
|---|---|---|---|
| D. 46,997 | 2/1915 | Howell | 4/255 |
| 1,349,885 | 8/1920 | Jenkins | 4/255 |
| 1,642,603 | 9/1927 | Conway | 248/351 |
| 3,108,443 | 10/1963 | Schuermann et al. | 206/206 |
| 3,138,803 | 6/1964 | Caplan et al. | 4/255 |
| 3,196,468 | 7/1965 | McWilliams . | |
| 3,221,349 | 12/1965 | Bradley . | |
| 3,261,034 | 7/1966 | Bradley . | |
| 3,381,320 | 5/1968 | Mott . | |
| 4,096,597 | 6/1978 | Duse | 4/255 |

FOREIGN PATENT DOCUMENTS

| | | | |
|---|---|---|---|
| 24358 | of 1911 | United Kingdom | 4/255 |
| 367800 | 2/1932 | United Kingdom | 248/351 |

*Primary Examiner*—Alexander Grosz
*Attorney, Agent, or Firm*—Henderson & Sturm

[57] ABSTRACT

A water bed apparatus (10) comprising an elongated cylindrical unit (11) having a support surface (12) and a contact surface (14) formed on opposite ends, wherein the apparatus is designed to assist a user in placing a bed sheet (23) around and under the bladder (25) of a water bed (20).

10 Claims, 5 Drawing Figures

FIG. 1.
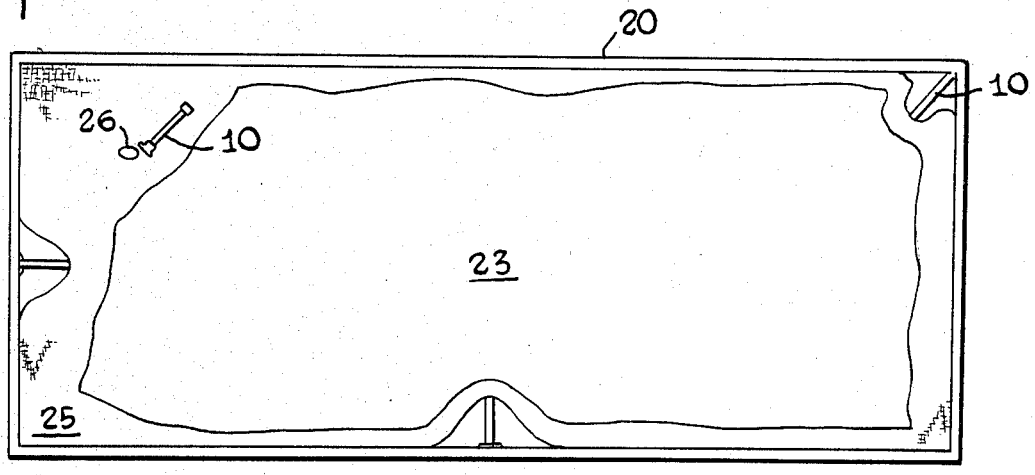
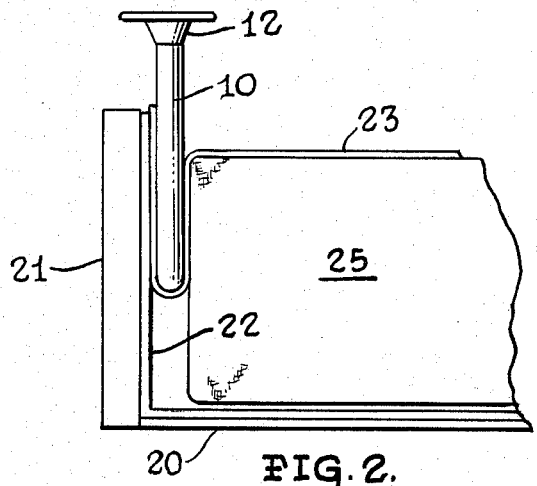
FIG. 2.
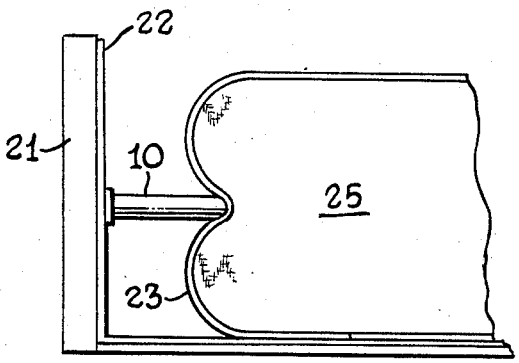
FIG. 3.
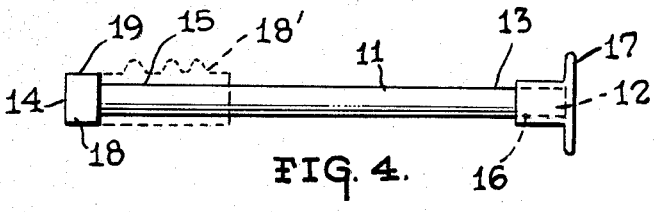
FIG. 4.
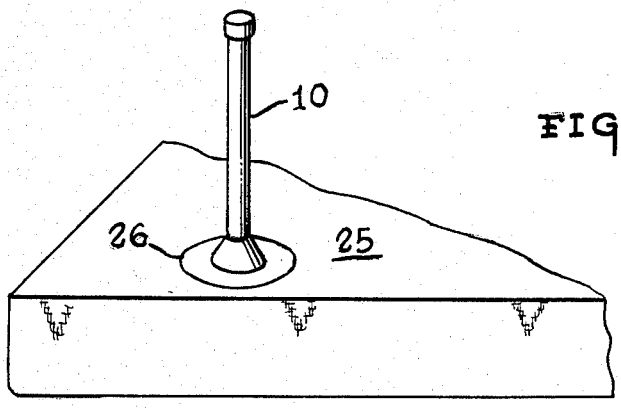
FIG. 5.

WATER BED BAR

TECHNICAL FIELD

This invention relates generally to a tool used in conjunction with a water bed to facilitate the positioning of a bed sheet on the water bed.

BACKGROUND ART

As far as the inventor is aware, there is virtually no prior art in this area of technology.

As a result of the foregoing situation, not only does the present invention satisfy all of the requirements for novelty and lack of obviousness; but it also provides a tool that greatly simplifies the placement of a bed sheet on a water bed.

Heretofore, when an individual wished to put a fresh bed sheet on a water bed it involved the use of both hands in an awkward and inefficient manner to accomplish the task.

Anyone that has performed this chore is well aware that it requires strength to lift the corners of the water bladder upwardly, while the end of the sheet is tucked around and under the bladder. In addition, after the sheet has been secured under the four corners, it is then necessary to wedge the sides of the sheet between the bladder and the lined bedframe.

This latter procedure normally results in the bedmaker's knuckles striking the framework, (particularly the headboard) in the process; and is further extremely difficult for women having long fingernails to perform.

DISCLOSURE OF THE INVENTION

The above stated problems are substantially resolved by the provision of the instant invention. The instant invention includes a bed making tool and method of use that simplifies the task of placing a bed sheet on a waterbed.

The tool of the instant invention includes an elongated cylindrical bar that is designed to be interposed between the bedframe and liner and the bed sheet and water bladder.

One end of the bar is designed to force the sheet between the liner and water bladder, and then maintain the sheet and bladder a predetermined distance from the linear and bedframe.

The other end of the bar is designed to brace the bar against the liner in a relatively stationary position, while the sheet is being tucked under the water bladder.

Another feature of this tool is that it may be designed as an elongated receptacle capable of containing a liquid, such as water conditioner; so that it will perform a dual function, with the basic tool remaining after the conditioner has been poured into the water bladder. This last feature should enhance the commercial attractiveness of the tool, and make it a particularly desirable item to purchase.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a top plan view of a water bed showing some of the proposed dispositions of the water bed tool;

FIG. 2 is a detail view of the tool in its initial position with respect to the water bed components;

FIG. 3 is a detail view of the tool in its final position with respect to the water bed components;

FIG. 4 is a plan view of the tool; and

FIG. 5 illustrates an alternate use of the tool.

BEST MODE FOR CARRYING OUT THE INVENTION

Referring now to the drawings, and in particular to FIG. 4, the apparatus may be seen as depicted generally by the numeral 10. The apparatus (10) includes generally an elongated cylindrical unit (11) having a support surface element (12) provided on one end (13), and a generally smooth contact surface element (14) provided on its other end (15).

In one form of the preferred embodiment, the cylindrical unit (11) is fabricated from a solid piece of material such as wood or plastic. In another form of the preferred embodiment, the cylindrical unit is formed from a solid piece of material such as wood or plastic. In another form of the preferred embodiment, the cylindrical unit is formed from a hollow tubular length of material such as wood, metal, plastic or glass.

In both of the aforementioned forms of the preferred embodiment, the cylindrical unit (11) would have an external configuration similar to the configuration illustrated in FIG. 4. The cylindrical unit (11) would also have the support and contact surfaces (12) and (14) provided on its ends.

The support surface (12) may include a base member (16) that frictionally or threadedly engages one end (13) of the cylindrical unit. The base member (16) is preferably fabricated from a smooth, surfaced material, such as metal, rubber, or plastic; and is further provided with an enlarged flange portion (17), which provides a large surface area for the support surface (12).

The contact surface (14) may include a cap member (18) that frictionally or threadedly engages the other end (15) of the cylindrical unit. The cap member is also fabricated from a smooth surfaced material such as rubber, metal or plastic; and is further provided with curved edges on the surfaces (19) that would reasonably be expected to come into contact with the water bed components, which will be described shortly.

In an alternate form of the preferred embodiment (not shown) the entire apparatus is formed from a solid piece of material, and may either assume the external configuration illustrated in FIG. 4, or merely comprise an elongated solid bar having at least one rounded end.

The water bed is designated generally as (20), and as is illustrated in the various figures, the water bed components comprise; a rigid bed frame (21); a bed frame liner (22); a bed sheet (23) and a water bladder (25) having a filling closure (26).

Having described the basic apparatus (10), and the components of the water bed (20) that it is employed in conjunction with, the next step will be to describe the method of using the tool. As can be seen by reference to FIGS. 2 and 3, the contact surface (14) of the cylindrical unit (11) is used to force a portion of the bedsheet (23) in between the water bladder (25) and the bed frame (21) and bed liner (22). At a point approximately half way down the side of the water bladder (25) the apparatus (10) is rotated 90° to bring the support surface (12) into bracing contact with the bed frame (21) and bed liner (22).

Once the tool (10) is in this position, it can be released, and the weight of the water bladder (25) will retain the tool in the position illustrated in FIG. 3. At this time the bed sheet can be manually forced underneath the water bladder. The tool can be removed, and the method repeated at various points around the periphery of the water bed to complete the fitting of the sheet around the water bladder.

As was mentioned earlier in the specification, this invention also contemplates filling the hollow interior of one form of the preferred embodiment, with a water conditioner (not shown), so that the apparatus will also serve as a receptacle for liquid and/or particulate material.

As shown in FIG. 5 the water conditioner can be introduced into the water bladder 25 by opening the bladder closure 26, removing one of the end structures (12) or (14) of the apparatus, and emptying the contents of the receptacle into the water bladder.

In another form of the preferred embodiment illustrated in FIG. 4 the end cap 18 may be fabricated in the form of a bicycle handle grip member 18′ (shown in phantom). It should also be noted that this grip member 18′ may be substituted for either or both of the end structures (12), (14) in keeping with the teachings of this invention.

It should be obvious at this point, that the length of the elongated cylindrical unit (11) should be sufficient to create ample space between the bed liner, and the sheet and bladder, to allow relatively unencumbered movement of the users hand in the vicinity of the tool, and in no instance should the length of the tool be less than (6″) six inches.

Obviously, many modifications and variations of the invention are possible in light of the above teachings. It is, therefore, to be understood that, within the scope of the appended claims, the invention may be practiced otherwise than as specifically described.

I claim:

1. An apparatus in combination with a water bed comprising; a bed frame; a bed liner, a bedsheet, and a water bladder having a filling closure whereby the apparatus is employed to facilitate the insertion of the bedsheet between the water bladder and the bed liner, and wherein the apparatus comprises;

an elongated cylindrical unit, a contact surface element provided on one end of the cylindrical unit, and adapted to contact the bedsheet, and a support surface element provided on the other end of the elongated cylindrical unit, and adapted to contact the bed liner inside the bed frame, to maintain the said contact surface in contact with the bed sheet.

2. An apparatus as in claim 1; wherein the elongated cylindrical unit is solid and fabricated from a single piece of material.

3. An apparatus as in claim 1; wherein the elongated cylindrical unit is fabricated from a length of hollow tubular material.

4. An apparatus as in claim 1; wherein, the contact surface element comprises a separate cap member secured to one end of the said cylindrical unit.

5. An apparatus as in claim 4; wherein, the support surface element comprises a separate base member secured to the other end of the said cylindrical element.

6. An apparatus as in claim 5; wherein, the elongated cylindrical unit is hollow and forms a receptacle adapted to contain a water conditioner.

7. An apparatus as in claim 6; wherein the cap member is removeably secured to the cylindrical unit.

8. An apparatus as in claim 6; wherein the base member is removeably secured to the cylindrical unit.

9. An apparatus as in claim 5; wherein, the base member is provided with an enlarged flange.

10. An apparatus as in claim 1; wherein the minimum length of the cylindrical unit is six inches.

* * * * *